US008039724B1

(12) United States Patent
Norman et al.

(10) Patent No.: US 8,039,724 B1
(45) Date of Patent: Oct. 18, 2011

(54) REMOVABLE ELECTRONIC DRUM HEAD FOR AN ACOUSTIC DRUM

(75) Inventors: James Norman, Los Angeles, CA (US); Brian Shim, Santa Monica, CA (US); Jan Wissmuller, Lincoln, RI (US)

(73) Assignee: Alesis, L.P. a Limited Partnership of Delaware, Cumberland, RI (US)

( * ) Notice: Subject to any disclaimer, the term of this patent is extended or adjusted under 35 U.S.C. 154(b) by 0 days.

(21) Appl. No.: 12/562,370

(22) Filed: Sep. 18, 2009

Related U.S. Application Data

(60) Provisional application No. 61/098,062, filed on Sep. 18, 2008, provisional application No. 61/144,279, filed on Jan. 13, 2009.

(51) Int. Cl.
*G10H 1/32* (2006.01)

(52) U.S. Cl. ..... 84/743; 84/723; 84/724; 84/725; 84/411 M

(58) Field of Classification Search ..... 84/723, 84/724, 725, 730, 743, 411 M
See application file for complete search history.

(56) References Cited

U.S. PATENT DOCUMENTS 3,026,759 A * 3/1962 Kleiner et al. ..... 84/411 R
3,105,406 A * 10/1963 Ippolito ..... 84/411 R
3,453,924 A * 7/1969 Glick et al. ..... 84/411 R
4,279,188 A * 7/1981 Scott ..... 84/723
4,589,323 A * 5/1986 Belli et al. ..... 84/411 R
4,742,753 A * 5/1988 Speed ..... 84/414
5,042,356 A * 8/1991 Karch ..... 84/725
5,293,000 A * 3/1994 Adinolfi ..... 84/730
5,492,047 A * 2/1996 Oliveri ..... 84/411 M
5,633,473 A * 5/1997 Mori et al. ..... 84/625
5,892,169 A * 4/1999 Shapiro ..... 84/411 M
5,977,473 A * 11/1999 Adinolfi ..... 84/723
6,121,538 A 9/2000 Yoshino et al.
6,271,458 B1 8/2001 Yoshino et al.
6,525,249 B1 * 2/2003 Suenaga ..... 84/411 R
6,700,044 B1 * 3/2004 Bencomo, Jr. ..... 84/411 R
6,756,535 B1 6/2004 Yoshino et al.
6,784,352 B2 * 8/2004 Suenaga ..... 84/411 R
6,921,857 B2 7/2005 Yoshino et al.
6,982,376 B2 * 1/2006 Wise ..... 84/600
7,038,117 B2 * 5/2006 Yoshino ..... 84/411 R
7,060,887 B2 * 6/2006 Pangrle ..... 84/724
7,135,630 B2 * 11/2006 Maruhashi et al. ..... 84/411 P
7,179,985 B2 * 2/2007 Pickens ..... 84/743
7,196,261 B2 * 3/2007 Suenaga ..... 84/730
7,385,135 B2 * 6/2008 Yoshino et al. ..... 84/738
7,394,014 B2 * 7/2008 Rosenberg ..... 84/725
7,429,698 B2 * 9/2008 Pickens ..... 84/411 R
7,439,432 B2 * 10/2008 Hiraku ..... 84/414
7,465,869 B1 * 12/2008 Freitas ..... 84/723
7,498,500 B2 * 3/2009 Rogers ..... 84/411 P
7,514,617 B2 * 4/2009 Rogers et al. ..... 84/411 P
7,525,032 B2 * 4/2009 Mishima ..... 84/477 R
7,569,758 B2 * 8/2009 Harada et al. ..... 84/411 M
2009/0179522 A1 * 7/2009 Cappello et al. ..... 310/334
2009/0229450 A1 * 9/2009 Hashimoto ..... 84/723

* cited by examiner

*Primary Examiner* — Elvin G Enad
*Assistant Examiner* — Robert W Horn
(74) *Attorney, Agent, or Firm* — Barlow, Josephs & Holmes, Ltd.

(57) ABSTRACT

A removable electronic drum head for an acoustic drum is disclosed. The electronic drum head includes an elastic strike layer, a rigid plate centered below the elastic strike layer. A first sensor is attached to a bottom surface of the rigid plate. A structural body supports the elastic strike layer, rigid plate and first sensor. The structural body is further adapted to attach to an acoustic drum. Other optional foam layers may be included above and below the rigid plate.

17 Claims, 4 Drawing Sheets

REMOVABLE ELECTRONIC DRUM HEAD FOR AN ACOUSTIC DRUM

CROSS-REFERENCE TO RELATED APPLICATIONS

The present patent document claims priority to earlier filed U.S. Provisional Patent Applications Nos. 61/098,062, filed on Sep. 18, 2008 and 61/144,279, filed on Jan. 13, 2009, the entire contents of which are incorporated herein by reference.

BACKGROUND OF THE INVENTION

1. Field of the Invention

The present patent document relates generally to electronic and acoustic drums and more specifically to a removable electronic drum head that can be attached to a conventional acoustic drum.

2. Background of the Related Art

Professional drummers face a number of problems with their chosen instrument because acoustic drum kits are generally large and take up a lot of space and are very loud when played. Acoustic drums are also limited in the types of sounds they are capable of producing. Additionally, acoustic drums are difficult to record using a microphone.

To solve some of these problems, the electronic drum kit was invented. There are many examples of stand-alone electronic drum kits, including electronic drum kits made by Alesis, Simmons, Roland, and Yamaha. Electronic drum kits are easy to record and are capable of producing a wide range of musical effect, including effects not possible on a conventional acoustic drum kit. However, electronic drum kits are also large and require a lot of space. Electronic drum kits are also electronic only and are not capable of producing conventional acoustic percussion music.

However, most professional musicians and drummers prefer to have both an electronic drum kit and an acoustic kit, which effectively doubles the floor space required to store and use these instruments. Accordingly, there is a perceived need in the art to permit the use of an acoustic drum kit, but includes the advantages of an electronic drum kit.

SUMMARY OF THE INVENTION

The present invention solves the problems of the prior art by providing an electronic drum head that fits on top of a drummer's existing acoustic drums. When the drummer plays these heads, the drum head is muted, minimizing acoustic noise from the kit. Also, these electronic drum heads can be easily attached and removed, allowing the drummer to go back to playing his acoustic drums when desired. A separate electronic drum kit is not necessary, saving a lot of space. Electronic drums give the drummer access to an almost unlimited array of sounds, not limited to traditional drum sounds. Finally, electronic drums do not require a microphone for recording. The sounds can be recorded directly from the line outputs of the electronic drum head module.

An objective of the present invention is to create an easily removable electronic drum head that attaches to a traditional acoustic drum kit.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
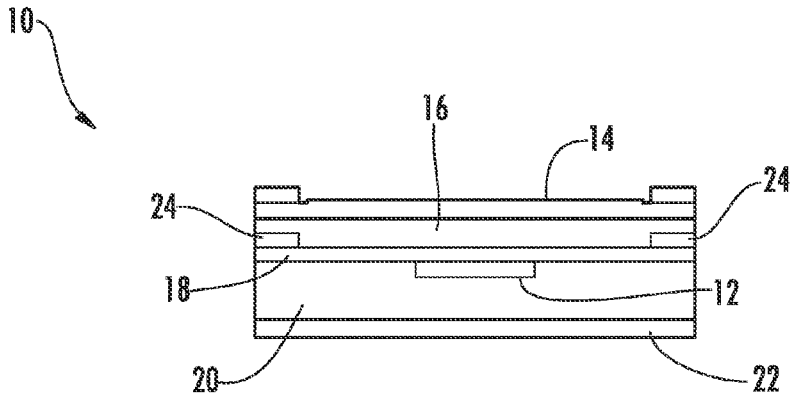
FIG. 1 is a side cross-section showing a first embodiment of the electronic drum head of the present invention.
Figure 2:
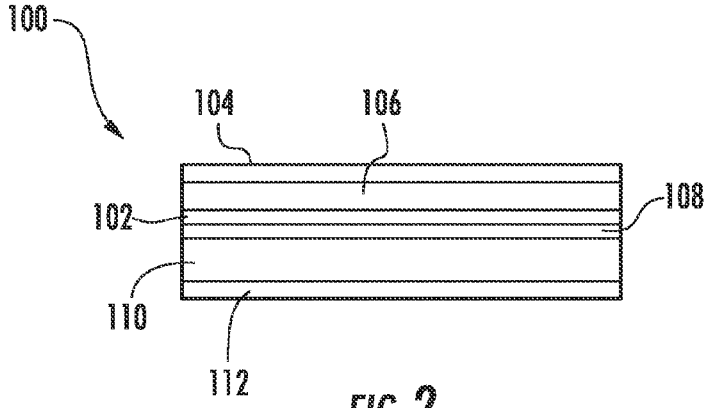
FIG. 2 is a side cross-section showing a second embodiment of the drum head of the present invention.

Referring to FIGS. 1 and 2, FIG. 1 generally shows a first embodiment 10 of the electronic drum head of the present invention and FIG. 2 shows a second embodiment 100 of the electronic drum head of the present invention. Both embodiments 10, 100 consist of a sandwich of layers. The composition of the layers depends on what type of sensor is used.

Turning to FIG. 1, the first embodiment 10 of the electronic drum head of the present invention includes six primary layers. The first embodiment 10 principally relies on a piezo sensor 12 to detect the drum hits sandwiched between several layers of resilient material. The top layer is an elastic or resilient layer 14 to absorb the strike of the drumstick. The top elastic layer 14 can be formed from any number of artificial or natural rubber compounds. The next layer 16 is an optional layer of foam, rubber, or other elastic material. The next layer is a flat rigid plate 18, usually made of metal, but could be made of plastic or other hard material. Centered on the bottom surface of the rigid plate 18 is the piezo sensor 12. The next layer 20 is an optional layer of foam, rubber, or other elastic material configured to support the rigid plate 18 and piezo sensor 12. The final layer 22 is an optional structural body to support the entire assembly from the bottom and permit the first embodiment to be mounted to an acoustic drum, which will be further described below.

An optional addition to the first embodiment is a rimshot sensor 24. Preferably, the rimshot sensor 24 is a membrane switch or Force Sensing Resistor ("FSR") aligned along the outer edge of the drum head.

Referring now to FIG. 2, the second embodiment 100 also includes a sensor 102 to detect drumstick strikes. For the sensor 102, the second embodiment relies principally on a membrane switch or FSR to detect the drum strikes. The top layer 104 is an elastic or resilient layer to absorb the strike of the drumstick. The top elastic layer 104 can be formed from any number of artificial or natural rubber compounds. Beneath the top layer is an optional layer 106 of foam, rubber, or other elastic material to further absorb and muffle the impacts of a drumstick. Underneath the optional foam layer, the next layer is the sensor 102. Supporting the sensor, the next layer is a flat rigid plate 108, usually made of metal, but could be made of plastic or other hard material. Supporting the rigid plate 108, the next layer 110 is an optional layer of foam, rubber, or other elastic material. The final layer is an optional structural body 112 to support the entire assembly of the second embodiment. The optional structural body 112 may be configured to couple to the head of an acoustic drum, as described further below.

The second embodiment 100 may further include an additional piezo sensor configured to measure strike velocity (if a membrane switch is used) or to provide additional dynamic range in measuring strike velocity (if a FSR is used). If included the piezo sensor would preferably be coupled to the bottom surface of the rigid plate 108 to protect the piezo sensor from damage, similarly to the first embodiment 10.

The thickness of the foam and rubber layers can vary depending on the type of sensor used and the types of materials used in order to optimize the sensitivity of the sensors, yet protect them from damage due to vigorous drumstick strikes.

Figure 3:
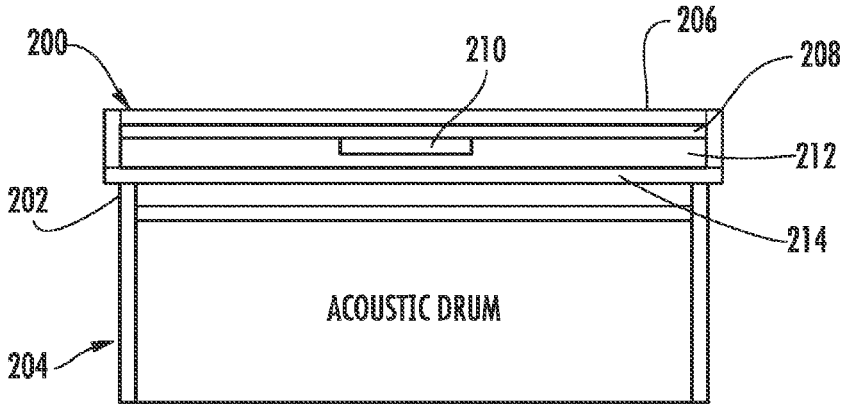
FIG. 3 is a side cross-section showing a first method of attaching an embodiment of the electronic drum head of the present invention on top of the rim of a prior art acoustic drum.
Figure 4:
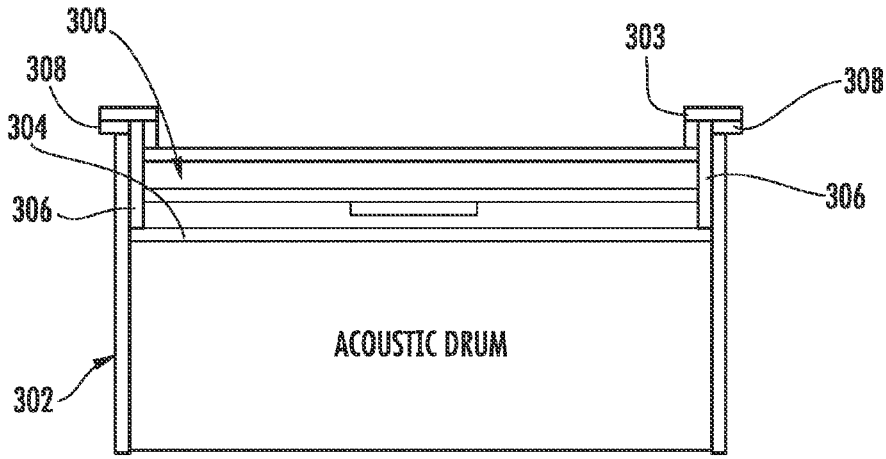
FIG. 4 is a side cross-section showing a second method of attaching an embodiment of the electronic drum head of the present invention underneath the head of a prior art acoustic drum.

Turning now to FIGS. 3-4, the first or second embodiments of the electronic drum head of the present invention may be configured to removable couple to the head of an acoustic drum. There are two methods for attaching the electronic drum head to the acoustic drum. First, the electronic drum head of the present invention may be attached to the outer rim of the acoustic drum as shown in FIG. 3. Second, the electronic drum head may be placed under the acoustic drum head to permit the drummer to strike the acoustic drum head surface directly as shown in FIG. 4. Each of these methods will be further described below.

Turning first to FIG. 3, the electronic drum head 200 sits on top of the outer rim 202 of the acoustic drum 204. From the top down, there is a layer of rubber or other elastic material (or layers of elastic materials) 206, followed by a rigid plate 208, that supports a piezo sensor 210 on the bottom surface thereof, followed by a layer of foam 212 or other elastic material if necessary, followed by a structural base 214 which sits on the drum rim 202. Attachment to the rim 202 can be achieved by friction, clamps, or other retention method. The electronic drum head 200 may also be sized to nestle inside the rim 202 of the drum 204 as further described below.

The layers can be changed as previously described above for the first and second embodiments to accommodate a membrane switch or FRS as shown in FIGS. 1 and 2.

Turning now to FIG. 4, the second embodiment of the electronic drum head 300 may also be clamped down into the acoustic drum 302 by the acoustic drum head 303 and hardware. The electronic drum head 300 consists of a rigid tray 304 with a sidewall 306 and lip 308 extending outwardly from the top edge of the sidewall. The rigid tray 304 contains the layers of elastic material and the sensor. With the acoustic drum head 303 removed, the rigid tray 304 is placed in the acoustic drum 302 and suspended inside the acoustic drum 302. The lip 308 rests against the body of the acoustic drum 302. The acoustic drum head 303 is placed over this, and clamped into place, thereby trapping the electronic drum head 300 securely between the body of the drum 300 and the rim of the drum head 303.

This method has the advantage that the drummer is able to use the acoustic drum head 303 as the playing surface, which drummers are accustomed to hitting. The disadvantage, however, is that this method takes longer to install and remove the electronic drum head 300. Typically, acoustic drums 302 have five screws that would need to be removed in order to remove the acoustic drum head 303 and install the electronic drum head 300.

Figure 5:
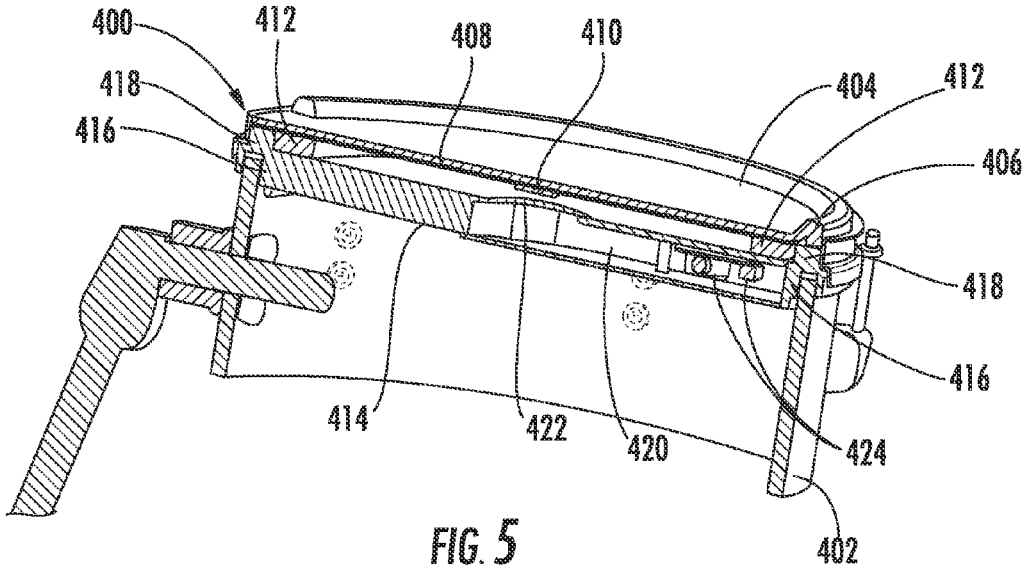
FIG. 5 shows a cross-section of a third embodiment of the electronic drum head of the present invention mounted to the top of the rim of a prior art acoustic drum.
Figure 6:
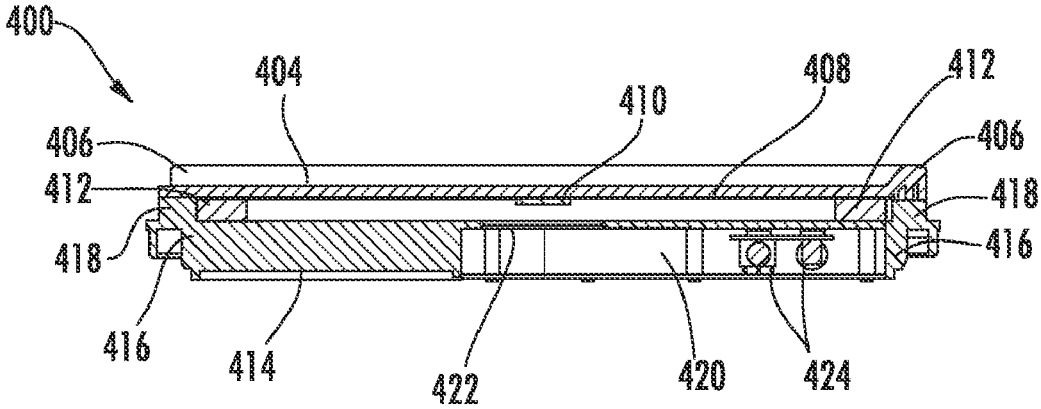
FIG. 6 shows a side cross-section of the third embodiment of the electronic drum head of the present invention.

Referring now to FIGS. 5 and 6, in a third embodiment, the electronic drum head 400 replaces the acoustic drum head completely. As earlier, the electronic drum head 400 is held in place by the acoustic drum hoop 402. However, the acoustic drum head (not shown) is not placed over the electronic drum head 400 in this embodiment. The electronic drum head 400 includes an elastic strike layer 404, which may include a raised rim 406 for rimshots. Beneath the strike layer 404 is a rigid plate 408. An optional foam layer (not shown, but see FIG. 1, 2 or 4) may be included between the strike layer 404 and rigid plate 408. A sensor 410 is attached to the bottom surface of the rigid plate 408. A supporting foam ring 412 supports the rigid plate 408 and elastic layer 404. A structural body 414 supports the supporting foam ring 412 and other layers. The structural body 414 includes a sidewall 416 and a lip 418 which are configured to nestle on the acoustic drum hoop 402. The electronic drum head 400 may also include a rimshot sensor, which would be placed underneath the raised rim 406 of the strike layer 404. The structural body 414 may also include a recessed region 420 and an aperture 424 formed through the body 414. Electrical signal wires (not shown) may be connected to the sensor 410 and put through the aperture 422 and recessed region 420 in the structural body 414. Electrical connectors 424 may be provided to attach the electrical signal wires.

Figure 7:
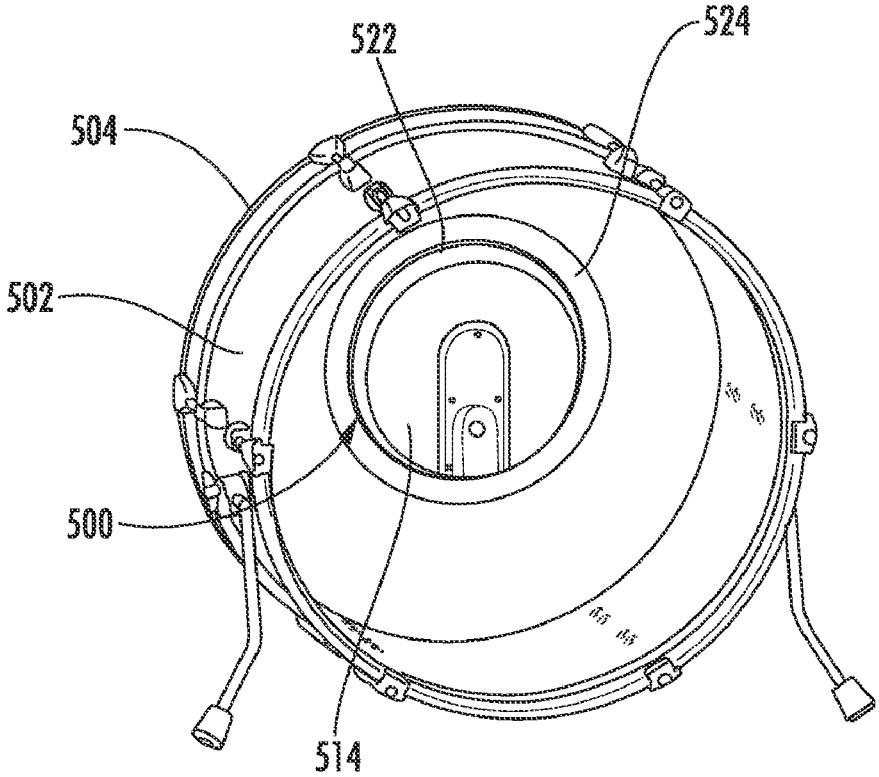
FIG. 7 shows a rear perspective view of a fourth embodiment of the electronic drum head of the present invention mounted to a kick drum.
Figure 8:
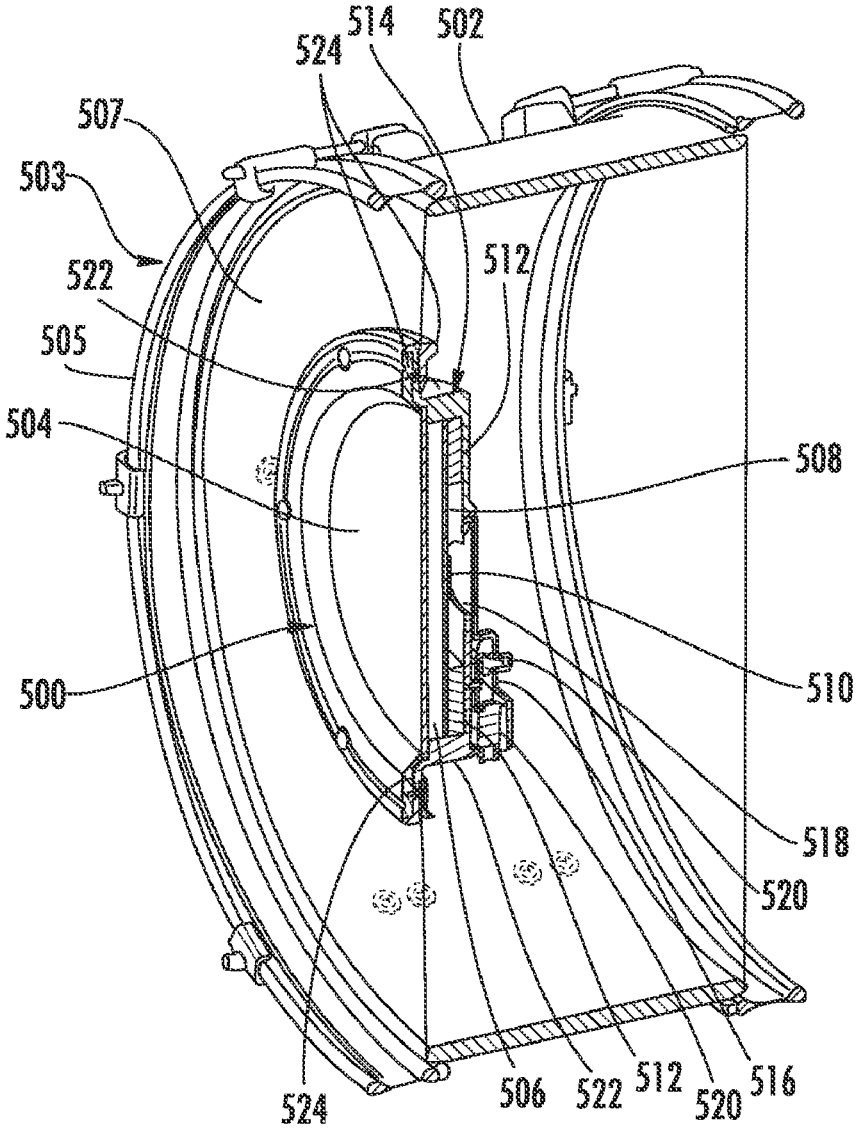
FIG. 8 shows a cross-section view of the fourth embodiment of the electronic drum head of the present invention mounted to a kick drum.

Referring now to FIGS. 7 and 8, in a fourth embodiment of the electronic drum head 500 intended mainly for bass drums 502 (also known as kick drums) is shown. The electronic drum head 500 is attached directly to an acoustic drum head support member 503 and suspended at the correct level to intercept the kick pedal beater (not shown). The drum head support member 503 includes a rim 505 adapted to be mounted on the bass drum 502 and false drum head 507 to suspend the electronic drum head 500.

The electronic drum head 500 includes an elastic strike layer 504. An optional foam layer 506 may be included behind the strike layer 504. A rigid plate 508 is also included with a sensor 510 connected thereto. An optional foam ring 512 may be further included behind the rigid plate. A structural body 514 is further included to house and support these aforementioned components. The structural body 514 may also include a recessed region 516 and an aperture 518 formed through the body 514. Electrical signal wires (not shown) may be connected to the sensor 510 and put through the aperture 518 and recessed region 516 in the structural body 514. Electrical connectors 520 may be provided to attach the electrical signal wires. The structural body 514 further includes a sidewall 522 and a lip 524 extending therefrom. A retaining ring 526 is adapted to attach to the lip 524 and trap the false drum head 507 therebetween.

In all of the embodiments, a membrane switch or Force Sensing Resistor may be used interchangeably with appropriate modifications to the size, density and resiliency of the intervening and supporting layers.

Therefore, it can be seen that the present invention provides a unique solution to the problem of providing an electronic drum head that can be coupled to an existing set of acoustic drums to conserve space and provide the musician with a familiar and comfortable playing arrangement. Furthermore the electronic drum head provides the advantages of being easily recordable and providing the musician with a wide variety of programmable sounds, not necessarily limited to acoustic drum sounds.

It would be appreciated by those skilled in the art that various changes and modifications can be made to the illustrated embodiments without departing from the spirit of the present invention. All such modifications and changes are intended to be within the scope of the present invention except insofar as limited by the appended claims.

What is claimed is:

1. An electronic drum head, comprising:

an elastic strike layer;

a rigid plate centered below the elastic strike layer;

a first sensor attached to a bottom surface of the rigid plate; and a structural body supporting the elastic strike layer, rigid plate and first sensor from below, the structural body having an upwardly extending sidewall configured and arranged to insert into a drum hoop and a lip extending outwardly from the sidewall configured and arranged to hook over an edge of the drum hoop.

2. The electronic drum head of claim 1, further comprising a second sensor beneath said elastic strike layer.

3. The electronic drum head of claim 1, further comprising a foam layer beneath said elastic strike layer.

4. The electronic drum head of claim 1, further comprising a foam layer beneath said rigid plate.

5. The electronic drum head of claim 1, wherein said first sensor is a piezo sensor.

6. The electronic drum head of claim 1, wherein said first sensor is a membrane sensor.

7. The electronic drum head of claim 1, wherein said first sensor is a force sensing resistor.

8. The electronic drum head of claim 2, wherein said second sensor is a piezo sensor.

9. The electronic drum head of claim 2, wherein said second sensor is a membrane sensor.

10. The electronic drum head of claim 2, wherein said second sensor is a force sensing resistor.

11. The electronic drum head of claim 1, wherein said elastic strike layer further includes an integrally formed raised rim.

12. The electronic drum head of claim 4, wherein said foam layer beneath said rigid plate is a foam ring.

13. The electronic drum head of claim 1, further comprising a surface defining an aperture therethrough a center of the structural body.

14. The electronic drum head of claim 1, further comprising a surface defining a recessed region on a bottom of the structural body.

15. An electronic drum, comprising:

an elastic strike layer;

a rigid plate centered below the elastic strike layer;

a first sensor attached to a bottom surface of the rigid plate;

a drum hoop; and a structural body supporting the elastic strike layer, rigid plate and first sensor from below, the structural body having an upwardly extending sidewall configured and arranged to insert into to the drum hoop and a lip extending outwardly from the sidewall configured and arranged to hook over an edge of the drum hoop.

16. The electronic drum of claim 15, further comprising a second sensor beneath said elastic strike layer.

17. The electronic drum head of claim 15, further comprising a foam ring beneath and supporting said rigid plate.

* * * * *